US009058911B2

(12) United States Patent
Ogura et al.

(10) Patent No.: US 9,058,911 B2
(45) Date of Patent: Jun. 16, 2015

(54) SHIELDED ELECTRIC WIRE WRAPPED WITH METAL FOIL

(75) Inventors: Hiroyuki Ogura, Susono (JP); Yurie Ooyama, Susono (JP); Daisuke Yagi, Susono (JP)

(73) Assignee: Yazaki Corporation, Tokyo (JP)

( * ) Notice: Subject to any disclaimer, the term of this patent is extended or adjusted under 35 U.S.C. 154(b) by 93 days.

(21) Appl. No.: 13/381,745

(22) PCT Filed: Jun. 3, 2010

(86) PCT No.: PCT/JP2010/059481

§ 371 (c)(1),
(2), (4) Date: Dec. 30, 2011

(87) PCT Pub. No.: WO2011/001786

PCT Pub. Date: Jan. 6, 2011

(65) Prior Publication Data

US 2012/0103648 A1 May 3, 2012

(30) Foreign Application Priority Data

Jul. 2, 2009 (JP) ..... 2009-157869

(51) Int. Cl.
*H01B 7/00* (2006.01)
*H01B 11/10* (2006.01)

(52) U.S. Cl.
CPC ..... *H01B 7/0045* (2013.01); *H01B 11/1091* (2013.01)

(58) Field of Classification Search
USPC ..... 174/102 R, 103, 104, 105 R, 106, 107, 174/108, 110 R, 113 R, 120 R, 120 SC, 121 R, 174/121 A, 110 PM
See application file for complete search history.

(56) References Cited

U.S. PATENT DOCUMENTS 3,280,246 A * 10/1966 Lawson et al. ..... 174/88 C
3,612,744 A * 10/1971 Thomas ..... 174/36
3,896,261 A * 7/1975 Cole ..... 174/115
4,327,246 A 4/1982 Kincaid
4,461,923 A * 7/1984 Bogese, II ..... 174/36

(Continued)

FOREIGN PATENT DOCUMENTS

JP 5-90739 U 12/1993
JP 3007035 U 2/1995

(Continued)

OTHER PUBLICATIONS

International Search Report (PCT/ISA/210), dated Aug. 10, 2010, issued by the International Searching Authority in corresponding International Application No. PCT/JP2010/059481.

(Continued)

*Primary Examiner* — William H Mayo, III
(74) *Attorney, Agent, or Firm* — Sughrue Mion, PLLC

(57) ABSTRACT

A shielded electric wire wrapped with metal foil includes coated conductive wires and a drain wire provided along the length of the coated conductive wires and grounded at the ends of the coated conductive wires and a metal foil member wrapped around the coated conductive wires and the drain wire forming a shielding layer covering the periphery of the coated conductive wires and the drain wire, wherein foil electrically connected parts, which are electrically connected to the drain wire, are provided at both ends or positions near both the ends of the coated conductive wires.

4 Claims, 10 Drawing Sheets

(56) References Cited

U.S. PATENT DOCUMENTS

| | | | | | |
|---|---|---|---|---|---|
| 4,490,574 | A * | 12/1984 | Tomita et al. | 174/36 |
| 4,510,346 | A * | 4/1985 | Bursh et al. | 174/36 |
| 4,800,236 | A * | 1/1989 | Lemke | 174/36 |
| 5,110,999 | A | 5/1992 | Barbera | |
| 5,208,426 | A * | 5/1993 | Kennedy et al. | 174/36 |
| 5,315,063 | A * | 5/1994 | Auclair | 174/78 |
| 5,416,269 | A * | 5/1995 | Kemp et al. | 174/36 |
| 5,446,239 | A * | 8/1995 | Mizutani et al. | 174/36 |
| 5,473,117 | A * | 12/1995 | Morgan et al. | 174/78 |
| 5,486,649 | A * | 1/1996 | Gareis | 174/36 |
| 6,085,416 | A * | 7/2000 | Ikeda | 29/864 |
| 6,246,001 | B1 * | 6/2001 | Fukui | 174/78 |
| 6,437,245 | B1 * | 8/2002 | Hayashi | 174/74 R |
| 6,441,308 | B1 * | 8/2002 | Gagnon | 174/105 R |
| 6,899,562 | B1 * | 5/2005 | Ruff et al. | 439/571 |
| 6,967,288 | B2 | 11/2005 | Ohsawa et al. | |
| 6,977,344 | B2 * | 12/2005 | Tanaka | 174/117 F |
| 7,276,664 | B2 * | 10/2007 | Gagnon | 174/105 R |
| 2002/0155738 | A1 | 10/2002 | Ohsawa et al. | |
| 2003/0213610 | A1 * | 11/2003 | Ide et al. | 174/117 F |
| 2004/0026101 | A1 * | 2/2004 | Ochi | 174/36 |
| 2004/0154826 | A1 | 8/2004 | Tanaka | |
| 2010/0025072 | A1 | 2/2010 | Okano et al. | |
| 2011/0247856 | A1 * | 10/2011 | Matsuda et al. | 174/108 |

FOREIGN PATENT DOCUMENTS

| | | | |
|---|---|---|---|
| JP | 7-105748 | | 4/1995 |
| JP | 11-353951 | A | 12/1999 |
| JP | 2002-304917 | A | 10/2002 |
| JP | 2002-319319 | A | 10/2002 |
| JP | 2003-198178 | A | 7/2003 |
| JP | 2007-311045 | A | 11/2007 |
| JP | 2008-198577 | A | 8/2008 |
| JP | 2009-093934 | A | 4/2009 |
| JP | 2010-56080 | A | 3/2010 |
| WO | 0217333 | A1 | 2/2002 |

OTHER PUBLICATIONS

Written Opinion (PCT/ISA/237) of the International Searching Authority, issued on Aug. 10, 2010 in corresponding International Application No. PCT/JP2010/059481.

Japanese Office Action issued Oct. 15, 2013, in corresponding Application No. 2009-157869.

Japanese Office Action issued Jul. 9, 2013, in corresponding Application No. 2009-157869.

Office Action dated Jan. 30, 2014, issued by the State Intellectual Property Office of the People's Republic of China in counterpart Chinese Application No. 201080030126.3.

Communication from the European Patent Office issued Jan. 22, 2014 in a counterpart European Application No. 10793956.3.

Office Action issued Sep. 16, 2014 by the Japanese Patent Office in corresponding Application No. 2014-005266.

Office Action dated Aug. 11, 2014 issued by the State Intellectual Property Office of the People's Republic of China in counterpart Chinese Patent Application No. 201080030126.3.

Communication from the Japanese Patent Office dated Feb. 18, 2014, in a counterpart Japanese application No. 2009-157869.

Office Action dated Feb. 10, 2015 issued by Japanese Patent Office in counterpart Japanese Patent Application No. 2014-005266.

* cited by examiner

INFLUENCE OF A DEGREE OF CONTACT OF FOIL-DRAIN WIRES ON THE SHIELDING EFFECT
WIRE LENGTH IS 10 cm, AND THERE ARE PEELED PARTS.
SIMULATION RESULTS IN THE CASE WHERE A 1mm PEELED PART OF
A TERMINAL IS AN OBJECT TO BE MEASURED

INFLUENCE OF A DEGREE OF CONTACT OF FOIL-DRAIN WIRES ON THE SHIELDING EFFECT WIRE LENGTH IS 10 cm, AND THERE ARE PEELED PARTS.
SIMULATION RESULTS FOR INFLUENCE OF CONTACT RESISTANCE ON CONTACTED PORTIONS OF BOTH THE ENDS, IN THE CASE WHERE A 1 mm PEELED PART OF A TERMINAL IS AN OBJECT TO BE MEASURED

INFLUENCE OF A DEGREE OF CONTACT OF FOIL-DRAIN WIRES ON THE SHIELDING EFFECT SIMULATION RESULTS IN THE CASE WHERE THE WIRE LENGTH IS 10 cm, AND THERE ARE NO PEELED PARTS BY COVERING THE PEELED PARTS WITH A CYLINDRICAL CONDUCTOR

*Fig. 6* INFLUENCE OF A DEGREE OF CONTACT OF FOIL-DRAIN WIRES ON THE SHIELDING EFFECT SIMULATION RESULTS FOR INFLUENCE OF INCREASE AND DECREASE OF THE NUMBER OF CONTACT POINTS, IN THE CASE WHERE THE WIRE LENGTH IS 10 cm, AND THERE ARE NO PEELED PARTS, BY COVERING THE PEELED PARTS WITH A CYLINDRICAL CONDUCTOR

INFLUENCE OF A DEGREE OF CONTACT OF FOIL-DRAIN WIRES ON THE SHIELDING EFFECT SIMULATION EFFECTS IN THE CASE WHERE THE WIRE LENGTH IS 50 cm, THERE ARE PEELED PARTS, A 5 mm PEELED PART IS ALSO AN OBJECT TO BE MEASURED

INFLUENCE OF A DEGREE OF CONTACT OF FOIL-DRAIN WIRES ON THE SHIELDING EFFECT SIMULATION RESULTS, IN THE CASE WHERE THE WIRE LENGTH IS 50 cm, AND THERE ARE NO PEELED PARTS, BY COVERING THE PEELED PARTS WITH A CYLINDRICAL CONDUCTOR

INFLUENCE OF A DEGREE OF CONTACT OF FOIL-DRAIN WIRES ON THE SHIELDING EFFECT
SIMULATION RESULTS, IN THE CASE WHERE THE WIRE LENGTH IS 50 cm, AND
THE RANGE IN WHICH THE DRAIN WIRE IS PROVIDED IS LIMITED TO A DEFINED LENGTH

×: CURRENT IN AN INWARD DIRECTION OF THE PAPER SURFACE
●: CURRENT IN A FORWARD DIRECTION OF THE PAPER SURFACE

SHIELDED ELECTRIC WIRE WRAPPED WITH METAL FOIL

TECHNICAL FIELD

The present invention is related to a shielded electric wire wrapped with metal foil, in which a metal foil member wrapped around a coated conductive wire and a drain wire provided along the length of the coated conductive wire is utilized as a shielding layer.

BACKGROUND ART

For electric wiring in the inside of a car, in particular, electric wiring of equipment that is easily affected by noise or easily generates noise, a shielded electric wire provided with an electric shielding layer around an internal conductor executing transmission of a signal is used.

A shielded electric wire available on the market generally consists of an internal conductor executing transmission of a signal, an insulation layer enclosing around the internal conductor, an external conductor functioning as a shielding layer enclosing the outer circumference of the insulation layer, and an insulation outer sheath covering the outer circumference of the external conductor. In general, the insulation layer and the insulation outer sheath are formed by extrusion molding.

The shielded electric wire available on the market is expensive compared to a common coated conductive wire having no shielding layer. Since the shielded electric wire has high bending strength, availability of arrangement thereof is inferior.

Instead of the expensive shielded electric wire available on the market, manufacturers, which have manufactured wire harness to be in a vehicle and others, have introduced a shielded electric wire wrapped with metal foil, in which a drain wire that is a naked conductor is provided along length of a general coated conductive wire, and a metal foil member is wrapped around the coated conductive wire and the drain wire, so that the wrapped metal foil member is utilized as a shielding layer (for example, refer to Patent Literatures 1 and 2).

In the shielded electric wire wrapped with metal foil, for example, a metal foil film, in which a metal foil layer is formed on one side surface of an insulation film, is used as the metal foil member. The metal foil film is wrapped around the outer circumference of the coated conductive wire and the drain wire while directing the metal foil layer toward the interior side, so that the metal foil layer is in contact with the drain wire, and the metal foil layer and the drain wire are in the electrically connected state. By grounding an end of the drain wire extending from an end of the coated conductive wire, the shielding layer can be easily grounded.

Since the shielded electric wire wrapped with metal foil has high flexibility, compared to the shielded electric wire available on the market, the availability of arrangement thereof can be improved. Since the number of core wires can be easily changed, the shielded electric wire wrapped with metal foil is suitable for shielding wiring of wire harness to be mounted in a vehicle, in which the number of core wires to be contained varies depending on equipment to be mounted in the vehicle.

CITATION LIST

Patent Literature

[PTL 1] JP-A-2009-93934
[PTL 2] JP-A-2007-311045

SUMMARY OF INVENTION

Technical Problem

However, in the shielded electric wire wrapped with metal foil in which the outer circumference of the coated conductive wire and the drain wire is simply wrapped by the metal foil film, the wrapping of the metal foil film may be partially loosened due to bending upon arrangement of electric wires or other causes. Accordingly, a part of the metal foil layer may be easily separated from the drain wire. If the metal foil layer is partially separated from the drain wire, variation occurs in the length of the metal foil layer effectively functioning as a shielding layer. Accordingly, compared to the shielded electric wire available on the market, the shielded electric wire has problems in degradation of the shielding performance or occurrence of variation in the shielding performance.

In order to overcome the problems, for example, it is possible to stabilize the electrically connected state of the metal foil layer and the drain wire, by checking whether or not there is a non-contact portion between the metal foil layer and the drain wire, and filling a portion, at which the metal foil layer is separated from the drain wire, with a conductive adhesive, after the process for wrapping with the metal foil film is finished. However, carrying out the adhesion improving process increases the manufacturing process of the shielded electric wire wrapped with metal foil. Since a use amount of the conductive adhesive increases, manufacturing costs increase.

One of purposes of the present invention is, in order to solve the problems, to provide a shielded electric wire wrapped with metal foil, which exhibits excellent shielding performance and is manufactured by a simple manufacturing process thereby reducing manufacturing costs.

Solution to Problem

The object of the present invention is accomplished by the configuration set forth below.

(1) A shielded electric wire wrapped with metal foil comprising:

a coated conductive wire;

a drain wire, provided along a length of the coated conductive wire and grounded at ends of the coated conductive wire; and a metal foil member, wrapped around the coated conductive wire and the drain wire, and forming a shielding layer covering a periphery of the coated conductive wire and the drain wire, wherein both ends or positions near both the ends of the metal foil member, which are positioned near both ends of the coated conductive wire, are foil electrically connected parts, which are electrically connected to the drain wire.

(2) The shielded electric wire wrapped with metal foil described in said (1), wherein the drain wire is provided at a defined length of both the ends of the coated conductive wire.

According to the configuration set forth in (1) above, both the ends or positions near both the ends of the metal foil member wrapped around the outer circumference of the coated conductive wire and the drain wire are electrically connected to the drain wire. In this state, even if the metal foil member is not in contact with the drain wire at a center portion of the longitudinal direction of the coated conductive wire, the shielded electric wire wrapped with metal foil exhibits excellent shielding performance equal to that in the case where the metal foil member is in contact with the drain wire over the substantially whole length of the coated conductive wire. Accordingly, it is possible to stably produce a high-quality shielded electric wire wrapped with metal foil without causing variation in the shielding performance.

It is unnecessary to carry out the process for checking whether or not there is a non-contact portion between the metal foil member and the drain wire at the center portion of the longitudinal direction of the electric wire, or the process for filling the non-contact portion with a conductive adhesive, after the process for wrapping the outer circumference of the coated conductive wire and the drain wire with the metal foil member. Accordingly, the manufacturing process is simplified so that manufacturing costs are reduced.

According to the configuration set forth in (2) above, compared to the case where the drain wire is extended over the whole length of the coated conductive wire, the shielding performance is slightly degraded due to reduction of a conductor cross-sectional area of the metal foil layer and the drain wire. However, the accomplished shielding performance is relatively satisfactory and sufficiently in the utility scope.

If the range in which the drain wire is provided is limited to the defined length of both the ends of the coated conductive wire, a use amount of the drain wire is reduced. Due to reduction of the used material, cost reduction, weight reduction, and arrangement (flexibility) improvement can be accomplished.

DESCRIPTION OF EMBODIMENTS

Hereinafter, a preferable embodiment of a shielded electric wire wrapped with metal foil of the present invention will be described in detail with reference to the accompanying drawings.

Figure 1:
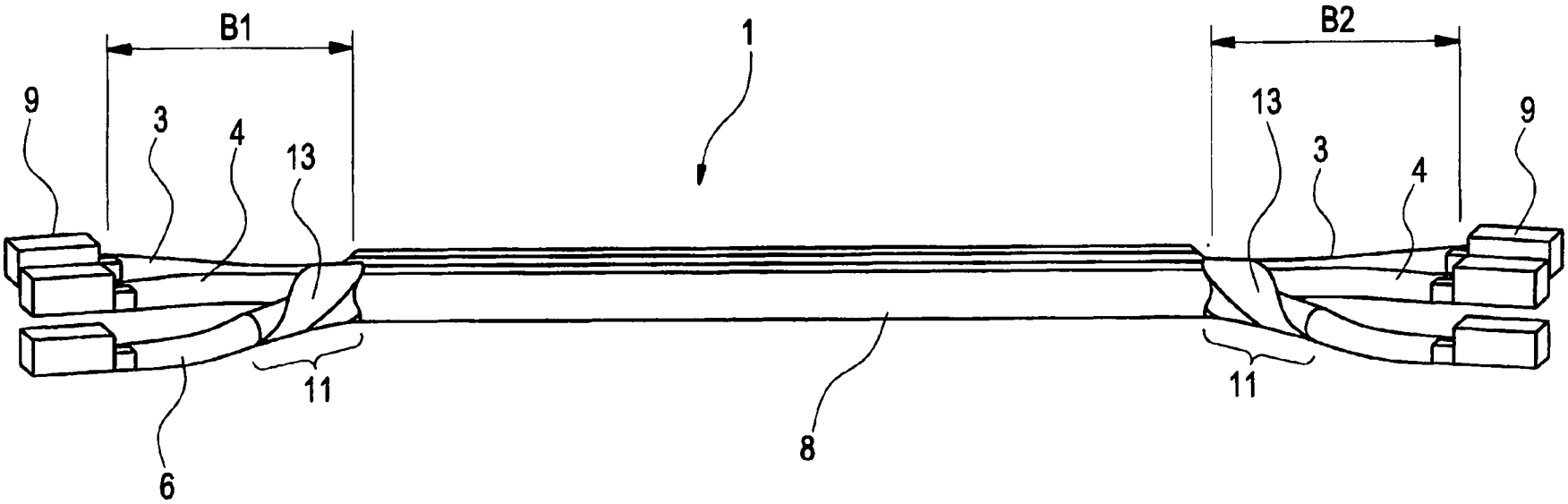
FIG. 1 is a perspective view of one embodiment of a shielded electric wire wrapped with metal foil according to the present invention.

FIG. 1 is a perspective view of one embodiment of a shielded electric wire wrapped with metal foil according to the present invention.

In the embodiment, a shielded electric wire 1 wrapped with metal foil is configured by two coated conductive wires 3 and 4 having no shielding layer, a drain wire 6 provided along the length of the coated conductive wires 3 and 4, and a metal foil member wrapped around the coated conductive wires 3 and 4 and the drain wire 6 and forming a shielding layer (conductive layer) covering the periphery of the coated conductive wires 3 and 4 and the drain wire 6. The shielded electric wire 1 wrapped with metal foil is used as a two-core shielded wire.

The drain wire 6 is a naked wire having substantially the same cross-sectional area as that of core wires (conductors) of the coated conductive wires 3 and 4. Length of the drain wire 6 is substantially the same as that of the coated conductive wires 3 and 4. A connection terminal 9 is connected to each of the ends of the coated conductive wires 3 and 4 and the drain wire 6. The drain wire 6 is grounded at grounded parts of equipment or others positioned at the ends of the coated conductive wires 3 and 4.

The metal foil member 8 is formed by providing an aluminum foil layer having a 20 μm thickness on one side surface of a polyethylene film, which is an insulation material. The aluminum foil layer functions as a shielding layer. The metal foil member 8 is wrapped around the outer circumstance of the coated conductive wires 3 and 4 and the drain wire 6, while the aluminum foil layer is directed toward the interior side. The aluminum foil layer is in contact with the drain wire 6, such that the wrapped metal foil member 8 is electrically connected to the drain wire 6.

In this embodiment, the range wrapped by the metal foil member 8 is set to be slightly shorter than the length of each of the coated conductive wires 3 and 4. As such, terminals of the shielded electric wire 1 wrapped by the metal foil have peeled parts B1 and B2, in which each of the coated conductive wires 3 and 4 is not covered with the metal foil member 8.

In this embodiment, both the ends of the metal foil member 8 positioned near both the ends of the coated conductive wires 3 and 4 are foil electrically connected parts 11, which are electrically connected to the drain wire 6. The foil electrically connected parts 11 maintain in the state that the metal foil layer (aluminum foil layer) of the metal foil member 8 is surely in contact with the drain wire 6. In this embodiment, the metal foil layer is in contact with the drain wire 6 via bonding and fixing by an adhesive tape 13. However, means for contacting the metal foil layer with the drain wire 6 are not limited to bonding and fixing by the adhesive tape 13. For example, adhesive fixing by a conductive adhesive may be utilized.

In the shielded electric wire 1 wrapped with metal foil, both the ends of the metal foil member 8 wrapped around the outer circumference of the coated conductive wires 3 and 4 and the drain wire 6 are electrically connected to the drain wire 6. In this state, even if the metal foil member 8 is not in contact with the drain wire 6 at a center part of the longitudinal direction of the coated conductive wires 3 and 4, the shielded electric wire 1 wrapped with metal foil exhibits excellent shielding performance equal to that in the case where the metal foil member 8 is in contact with the drain wire 6 over the substantially whole length of the coated conductive wires 3 and 4. Accordingly, it is possible to stably produce a high-quality shielded electric wire wrapped with metal foil without causing variation in the shielding performance.

It is unnecessary to carry out the process for checking whether or not there is a non-contact portion between the metal foil member 8 and the drain wire 6 at the center part of the longitudinal direction of the electric wire, and the process for filling the non-contact portion with a conductive adhesive, after the process for wrapping the outer circumference of the coated conductive wires 3 and 4 and the drain wire 6 with the metal foil member 8. Accordingly, the manufacturing process is simplified, so that manufacturing costs can be reduced.

Hereinafter, results of various shielding effect evaluation experiments (simulations) that have been conducted by the inventors of the present invention to verify the above-described operation and effects will be described.

Figure 2:
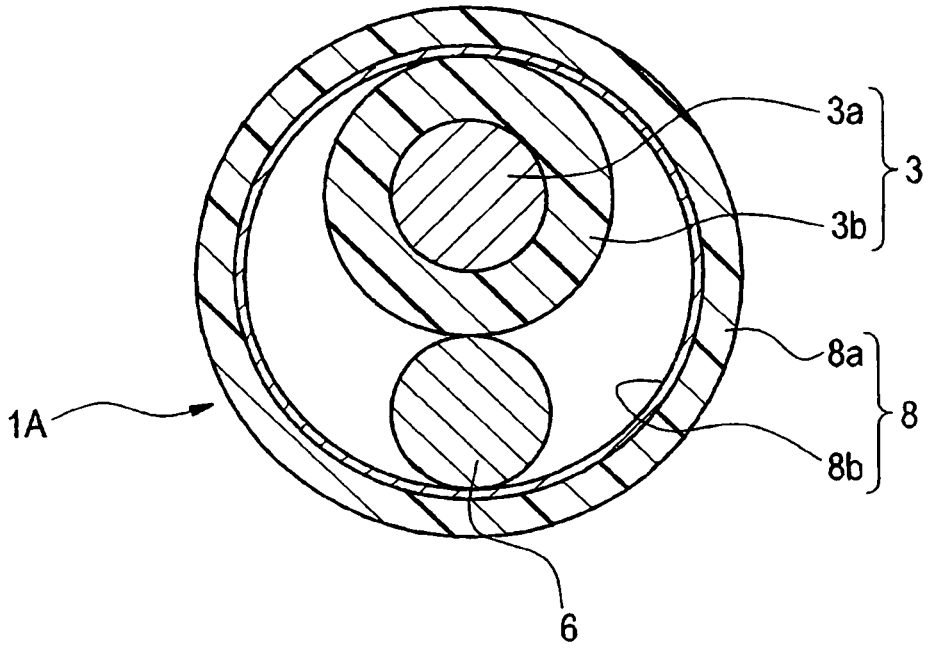
FIG. 2 is a horizontal cross-sectional view of a simulation model of the shielded electric wire wrapped with metal foil for evaluation of effects of the present invention.

In the experiments, instead of the shielded electric wire 1 wrapped with metal foil, a shielded electric wire 1A wrapped with metal foil in the horizontal cross-sectional view of FIG. 2 was used as a basic model for evaluation.

The shielded electric wire 1*a* wrapped with metal foil which is presented in FIG. 2 has a single core by excluding the coated conductive wire 4 from the shielded electric wire 1 wrapped with metal foil which is presented in FIG. 1.

In the shielded electric wire 1A wrapped with metal foil of FIG. 2, the coated conductive wire 3 is a halogen free electric wire, in which periphery of a core wire 3*a* having a 0.35 $mm^2$ nominal cross-sectional area is covered with an insulation coating 3*b* having a 2.9 relative dielectric constant. In the shielded electric wire 1A wrapped with metal foil, the drain wire 6 has the same nominal cross-sectional area as that of the core wire 3*a* and is a naked conductor, to which insulation coating is not applied. The evaluation experiments were conducted in the state that both the ends of the drain wire 6 are grounded.

In the shielded electric wire 1A wrapped with metal foil, the metal foil member 8 is formed by providing an aluminum foil layer 8*b* having a 20 μm thickness on one side surface of a polyethylene film 8*a*.

Since the metal foil member 8 is wrapped around the outer circumference of the coated conductive wire 3 and the drain wire 6, a true circle shape as shown in FIG. 2 is not actually formed in most cases.

Figure 3:
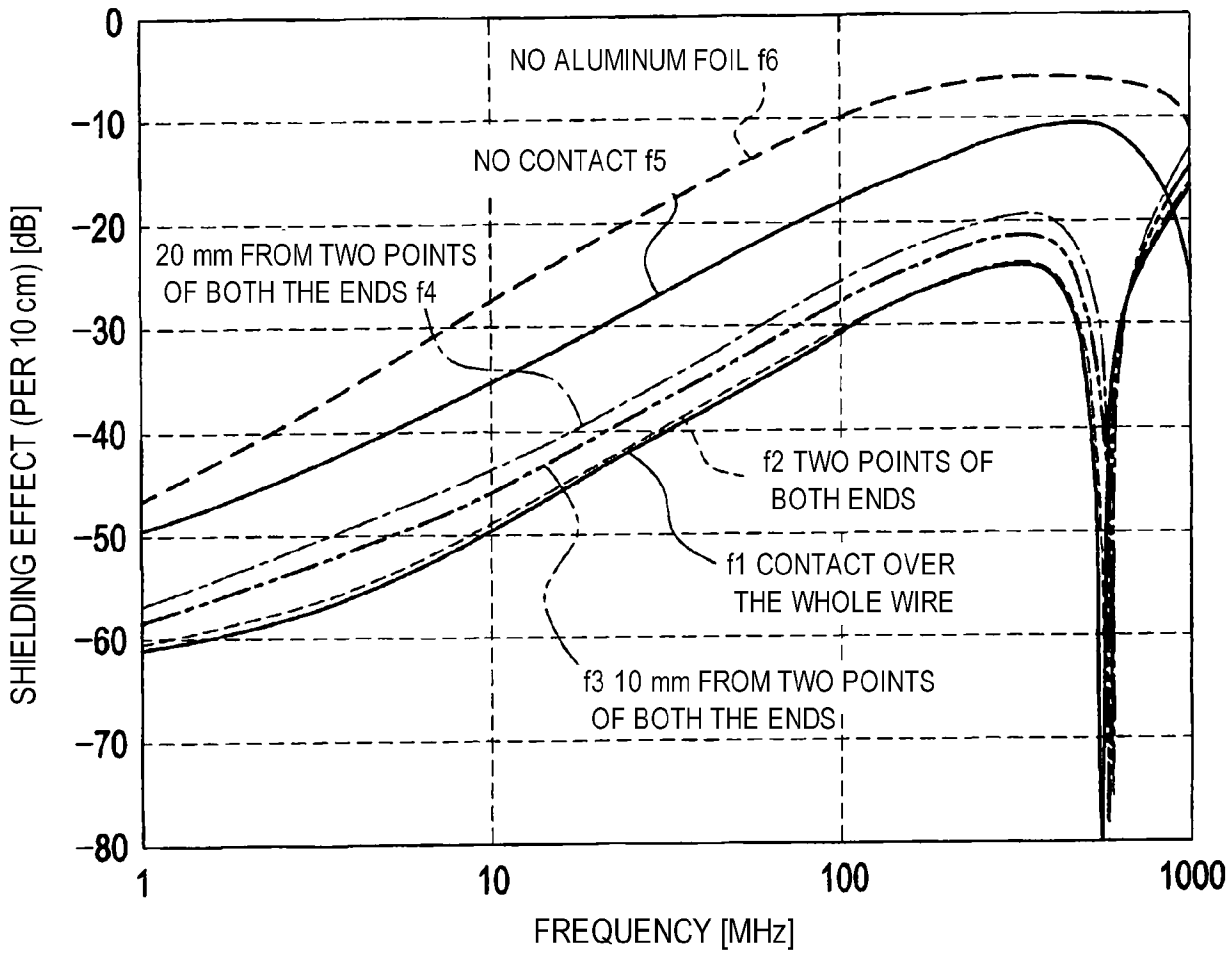
FIG. 3 is a graph showing measurement results obtained from measuring shielding performance by changing a degree of contact between a drain wire and a metal foil member, in the case where wire length of a coated conductive wire is 10 cm, and there are peeled parts, in which the metal foil member is peeled.

FIG. 3 is a graph showing six measurement results f1 to f6 obtained from measuring the shielding performance, by changing a degree of contact between the drain wire 6 and the metal foil member 8, under the basic condition that the wire length of the coated conductive wire 3 is 10 cm, and terminals have peeled parts B1 and B2 (refer to FIG. 1), in which the metal foil member 8 is peeled.

In FIG. 3, the measurement result f1 was obtained in the case where the metal foil member 8 wrapped around the coated conductive wire 3 and the drain wire 6 is electrically connected to the drain wire 6 over the whole length of the range wrapped by the metal foil member 8. In this case, the most excellent shielding effect is accomplished. In case of the shielded electric wire wrapped by the metal foil, from which the measurement result f1 was obtained, in order to assure the state that the whole length of the metal foil member 8 is in contact with the drain wire 6, the adhesion improving process, i.e., checking whether or not there is a non-contact portion between the metal foil layer and the drawn wire, and filling a portion, at which the metal foil layer is separated from the drain wire, with a conductive adhesive after the process for wrapping with the metal foil member 8, is carried out.

The measurement result f2 in FIG. 3 was obtained in the case where two points of both the ends of the metal foil member 8 wrapped around the coated conductive wire 3 and the drain wire 6 are electrically connected to the drain wire 6. The adhesion improving process to electrically connect the whole range of the wrapped metal foil member 8 to the drain wire 6 is not carried out. In electrically connecting both the ends of the metal foil member 8 to the drain wire 6, bonding and fixing by the adhesive tape 13 illustrated in FIG. 1 is utilized.

In the measurement result f2, reduction of the shielding effect is extremely minor, compared to the measurement result f1. The measurement result f2 exhibits the shielding effect substantially equal to that in the measurement result f1.

The measurement results f3 and f4 are similar to the measurement result f2 in that two points of both the ends of the metal foil member 8 are electrically connected to the drain wire 6. However, contact positions between the metal foil member 8 and the drain wire 6 are not both the ends of the metal foil member 8. In the measurement result f3, the contact positions are positions moved 10 mm from the ends toward the interior side. In the measurement result f4, the contact positions are positions moved 20 mm from the ends toward the interior side.

The shielding effect in the measurement result f3 is lower than that in the measurement result f2. The shielding effect in the measurement result f4 is lower than that in the measurement result f3. That is, as the contact positions between the metal foil member 8 and the drain wire 6 move from both the ends of the metal foil member 8 toward the interior side, the shielding effect is reduced. It confirms that optimum contact positions between the metal foil member 8 and the drain wire 6 are both the ends of the metal foil member 8 wrapped around the coated conductive wire 3 and the drain wire 6.

The measurement results f5 and f6 were obtained from measuring influence on the shielding effect depending on whether or not the metal foil member 8 is provided.

In the measurement result f5, the metal foil member 8 is merely wrapped around the outer circumference of the coated conductive wire 3 and the drain wire 6. Bonding or others by the adhesive tape 13 to surely contact the metal foil member 8 and the drain wire 6 was not conducted. The shielding effect in the measurement result f5 is significantly lower than that in the measurement result f4. It confirms that a sufficient shielding effect cannot be accomplished from simply wrapping with the metal foil member 8.

The measurement result f6 was obtained in the case where the polyethylene film 8*a* having no aluminum foil layer 8*b* is wrapped around the outer circumference of the coated conductive wire 3 and the drain wire 6. The shielding effect in the measurement result f6 is further reduced, compared to that in the measurement result f5.

The simulations presented in FIG. 3 confirm that when both the ends of the metal foil member 8 wrapped around the coated conductive wire 3 and the drain wire 6 are in contact with (conducted) the drain wire 6, even if the center part thereof is not in contact with the drain wire 6, the shielding effect substantially equal to that in the case where the whole length is in contact with the drain wire 6 can be achieved. As the contact positions between the metal foil member 8 and the drain wire 6 move from both the ends toward the interior side, the shielding effect is reduced. However, if the amount of the movement from both the ends toward the interior side is small, reduction of the shielding effect is minor.

Strictly speaking, the contact positions between the metal foil member 8 and the drain wire 6 do not need to be limited to both the ends of the metal foil member 8 wrapped around the coated conductive wire 3 and the drain wire 6. For example, even if the contact positions are set to positions near both the ends of the metal foil member 8 (e.g., within 10 mm from both the ends), the metal foil member 8 can exhibit excellent shielding performance. It confirms that the high-quality shielded electric wire wrapped with metal foil can be obtained without causing variation in the shielding performance.

When both the ends or positions near both the ends of the metal foil member 8 are in contact with the drain wire 6, even if the center part of the metal foil member 8 is not in contact with the drain wire 6, the shielding effect is the same. It also confirms that manufacturing costs can be reduced by simplifying the manufacturing process by not carrying out the adhesion improving process, i.e., checking whether or not there is a non-contact portion between the metal foil member 8 and the drain wire 6 at the center part of the metal foil member 8, or filling the non-contact portion with a conductive adhesive.

Figure 4:
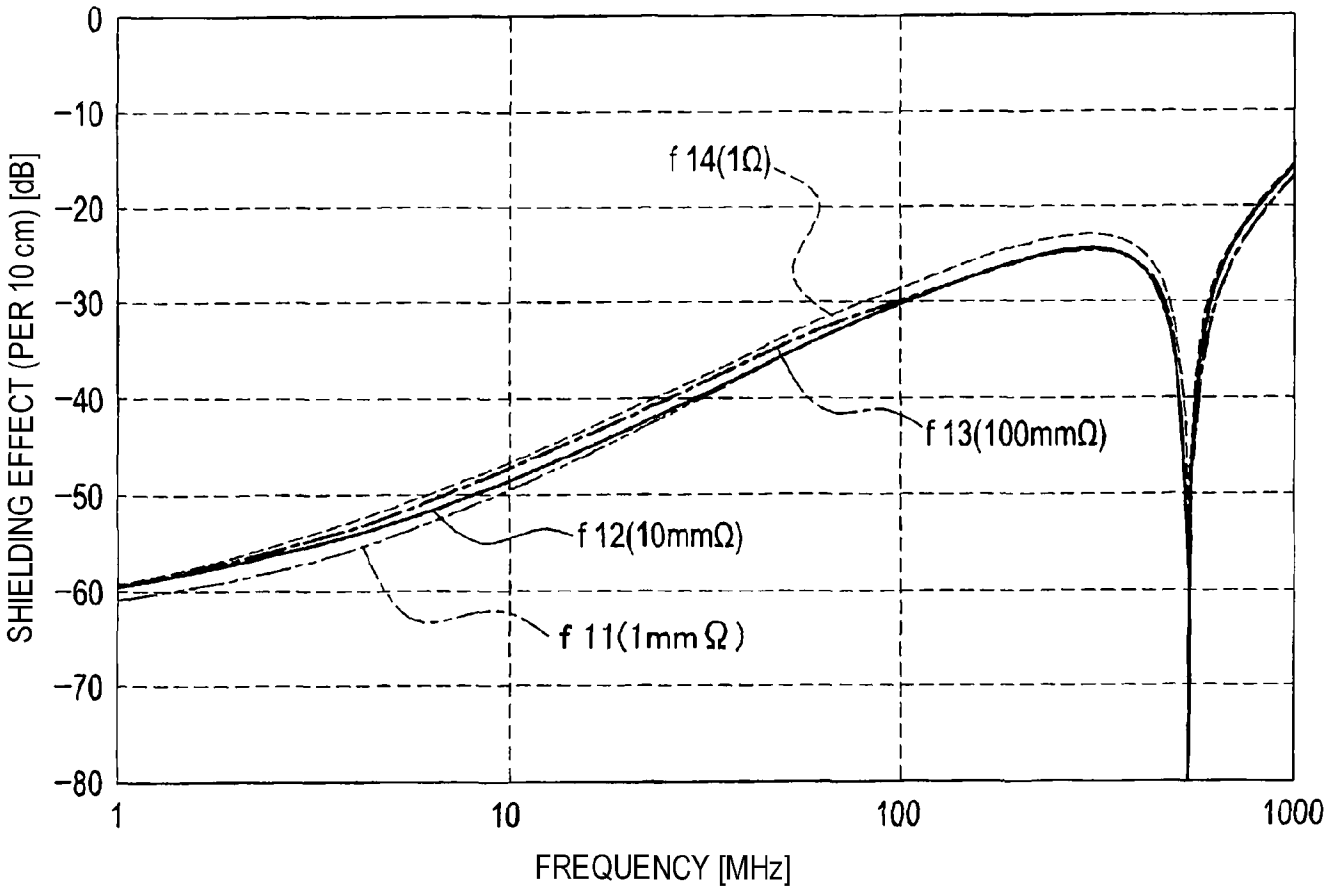
FIG. 4 is a graph showing measurement results obtained from measuring influence of a contact resistance value at each contact point on the shielding performance, in case of contact at two points of both ends as presented in FIG. 3.

FIG. 4 is a graph obtained from measuring the shielding effect by changing a contact resistance value at each contact point, to see influence of the contact resistance value at each contact point on the shielding effect, in addition to the measurement result f2 for contact at two points of both the ends in FIG. 3.

FIG. 4 shows a measurement result f11 when the contact resistance value is set to 1 mΩ, a measurement result f12 when the contact resistance value is set to 10 mΩ, a measurement result f13 when the contact resistance value is set to 100 mΩ, and a measurement result f14 when the contact resistance value is set to 1Ω.

Strictly speaking, the shielding effect tends to be reduced as the contact resistance value increases. However, there is no substantial reduction of the shielding effect in the simulated variation range of the contact resistance value (1 mΩ to 1Ω).

Accordingly, when both the ends of the metal foil member 8 are in contact with the drain wire 6 via bonding or others by the adhesive tape 13, variation in the shielding effect resulting from the contact resistance value does not occur. It confirms that the stable shielding performance is accomplished in the metal foil-wrapped shielded wire of the present invention.

Figure 5:
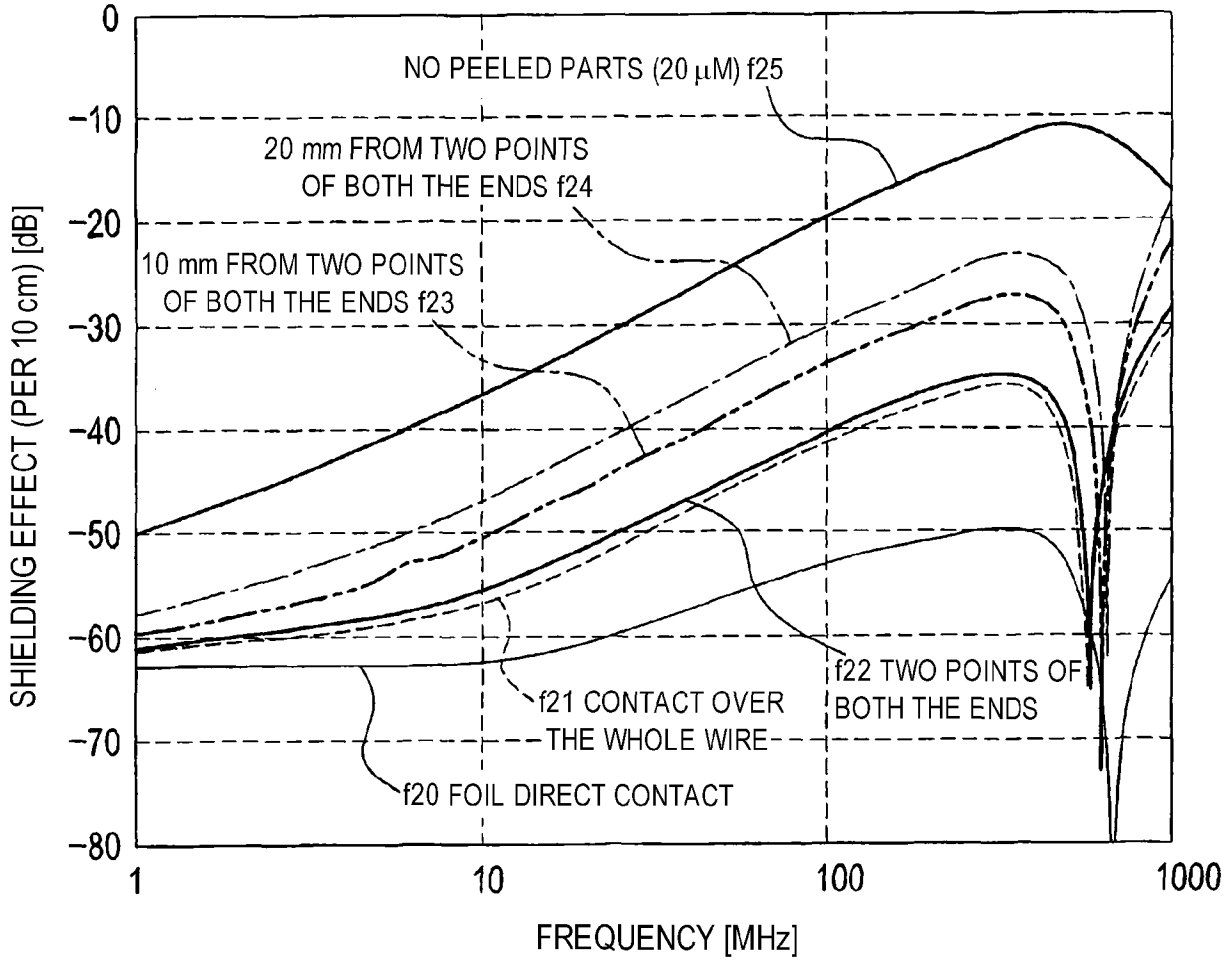
FIG. 5 is a graph obtained from measuring the shielding performance in the state that there are no peeled parts, by covering periphery of peeled parts with a cylindrical conductor, to see influence in the case where there are peeled parts and in the case where there are no peeled parts, in each of the simulations of FIG. 3.

FIG. 5 is a graph obtained from measuring the shielding performance in the state that there are no peeled parts, by covering the periphery of the peeled parts (parts B1 and B2 in FIG. 1) with a cylindrical conductor (cover), to see influence in the case where there are the peeled parts and the case where there are no peeled parts.

In FIG. 5, a measurement result f21 was obtained in the case where the whole length of the wrapped metal foil member 8 is electrically connected to the drain wire 6, and corresponds to the measurement result f1 of FIG. 3. A measurement result f22 was obtained in the case where two points of both the ends of the wrapped metal foil member 8 are electrically connected to the drain wire 6, and corresponds to the measurement result f2 of FIG. 3. A measurement result f23 was obtained in the case where two points moved 10 mm from both the ends of the wrapped metal foil member 8 toward the interior side are electrically connected to the drain wire 6, and corresponds to the measurement result f3 of FIG. 3. A measurement result f24 was obtained in the case where two points moved 20 mm from both the ends of the wrapped metal foil member 8 toward the interior side are electrically connected to the drain wire 6, and corresponds to the measurement result f4 of FIG. 3. A measurement result f25 was obtained in the case where the wrapped metal foil member 8 is not electrically connected to the drain wire 6, and corresponds to the measurement result f5 of FIG. 3.

From the measurement results f21, f22, f23, f24, and others, it is confirmed that the shielding effect is slightly improved in the case where there are no peeled parts. If more excellent shielding performance is required, the peeled parts at both the ends of the shielded electric wire wrapped with metal foil are preferably covered by a cylindrical conductor.

Additionally, FIG. 5 shows a measurement result f20 obtained in the case where the ends of the metal foil member 8 are not grounded via the drain wire 6 but are directly grounded.

The measurement result f20 exhibits a remarkably excellent shielding effect, compared to that in the measurement result f21, in which both the ends of the drain wire 6, to which the whole length of the metal foil member 8 is electrically connected, are grounded.

Accordingly, if possible, both the ends of the metal foil member 8 provided in the shielded electric wire wrapped with metal foil are preferably directly grounded.

Figure 6:
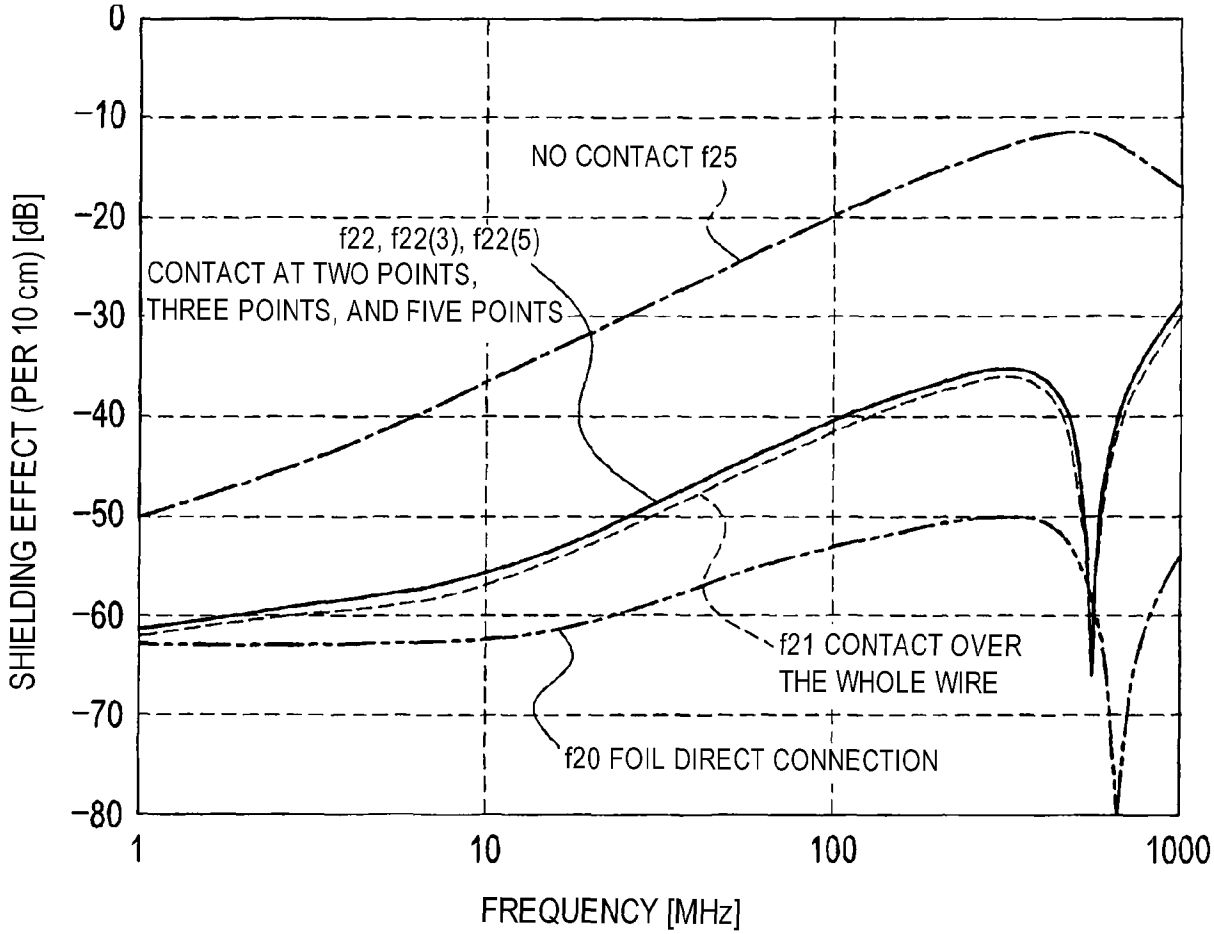
FIG. 6 is a graph showing measurement results obtained from measuring the shielding performance by increasing contact portions between the drain wire and the metal foil member, in the simulation of FIG. 5, in which both the ends of the metal foil member are in contact with the drain wire.

FIG. 6 adds a simulation, in which the number of contact points increases, with respect to the measurement result f22 of FIG. 5.

A measurement result f22(3) in FIG. 6 was obtained from measuring the shielding effect in the case where the contact portions between the metal foil member 8 and the drain wire 6 are three points, i.e., both the ends and the center part of the metal foil member 8. A measurement result f22(5) was obtained from measuring the shielding effect in the case where the contact portions between the metal foil member 8 and the drain wire 6 are five points, i.e., both the ends and three parts in the center of the metal foil member 8.

No difference was discovered between the measurement results f22(3) and f22(5), and the measurement result f22. The measurement results confirm that it is sufficient if the contact portions between the metal foil member 8 and the drain wire 6 are two portions, i.e., both the ends of the metal foil member 8.

Figure 7:
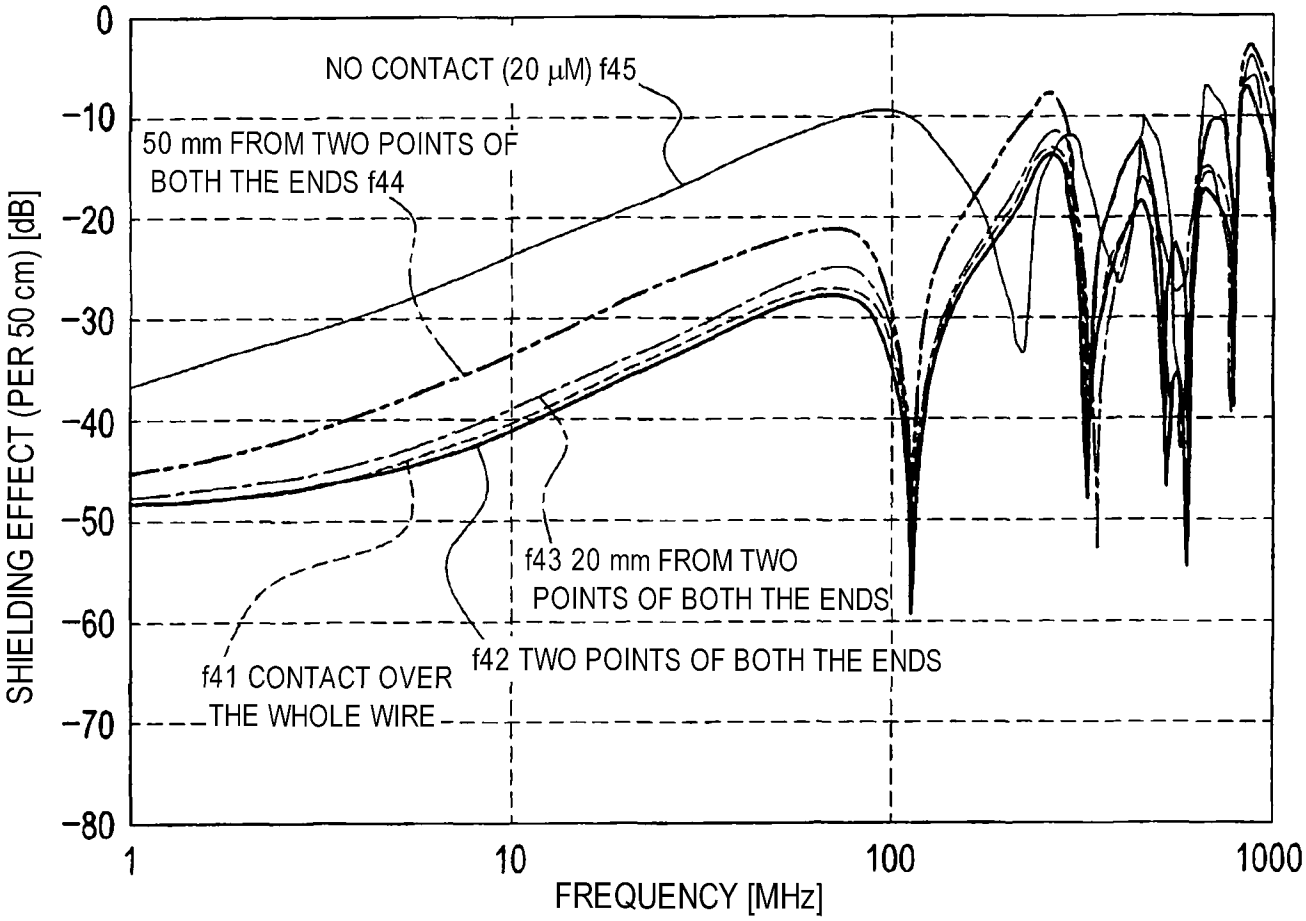
FIG. 7 is a graph showing measurement results obtained from measuring the shielding performance, by changing a degree of contact (contact point positions) between the drain wire and the metal foil member, in the case where the wire length of the coated conductive wire is 50 cm, and terminals have peeled parts, in which the metal foil member is peeled, in the cross-section structure presented in FIG. 2.

FIG. 7 is a graph showing five measurement results f51 to f55 obtained from measuring the shielding performance by changing a degree of contact (contact point positions) between the drain wire and the metal foil member, in the case where the wire length of the coated conductive wire is 50 cm, and terminals have peeled parts (5 mm), in which the metal foil member is peeled, in the cross-section structure of FIG. 2.

From comparison of the measurement results in FIG. 7 to the measurement results in FIG. 3, influence of the wire length can be evaluated. In FIG. 7, a measurement result f41 was obtained in the case where the metal foil member 8 wrapped around the coated conductive wire 3 and the drain wire 6 is electrically connected to the drain wire 6 over the whole length of the range wrapped by the metal foil member 8. The measurement result f41 exhibits the most excellent shielding effect in the simulations presented in FIG. 7.

A measurement result f42 in FIG. 7 was obtained in the case where two points of both the ends of the metal foil member 8 wrapped around the coated conductive wire 3 and the drain wire 6 are electrically connected to the drain wire 6.

The measurement result f42 exhibits the shielding effect substantially equal to that in the measurement result f41, in which the whole length of the metal foil member 8 is in contact with the drain wire 6, as in the simulations of FIG. 3.

Measurement results f43 and f44 are identical to the measurement result f42 in that two points of both the ends of the metal foil member 8 are electrically connected to the drain wire 6. However, in the measurement results f43 and f44, the contact positions between the metal foil member 8 and the drain wire 6 are not both the ends of the metal foil member 8. In the measurement result f43, the contact positions are positions moved 20 mm from the ends toward the interior side. In the measurement result f44, the contact positions are positions moved 50 mm from both the ends toward the interior side.

The shielding effect in the measurement result f43 is lower than that in the measurement result f42. The shielding effect in the measurement result f44 is lower than that in the measurement result f43. As the contact positions between the metal foil member 8 and the drain wire 6 move from both the ends of the metal foil member 8 toward the interior side, the shielding effect is reduced. This tendency is identical to that in the simulations of FIG. 3. It confirms that optimum contact positions between the metal foil member 8 and the drain wire 6 are both the ends of the metal foil member 8 wrapped around the coated conductive wire 3 and the drain wire 6.

A measurement result f45 was obtained from measuring influence on the shielding effect depending on whether or not the metal foil member 8 is provided.

In the measurement result f45, the metal foil member 8 is merely wrapped around the outer circumference of the coated conductive wire 3 and the drain wire 6, and bonding or others by the adhesive tape 13 to surely contact the metal foil member 8 and the drain wire 6 with each other was not carried out. The shielding effect in the measurement result f45 is significantly lower than that in the measurement result f44. It confirms that a sufficient shielding effect cannot be achieved simply by wrapping with the metal foil member 8.

From comparison of the measurement results in FIG. 7 to the measurement results in FIG. 3, it was confirmed that when both the ends of the metal foil member 8 are in contact with the drain wire 6, an excellent shielding effect, which is substantially equal to that in the case where the whole length of the metal foil member 8 is in contact with the drain wire 6, can be achieved, regardless of the wire length.

Figure 8:
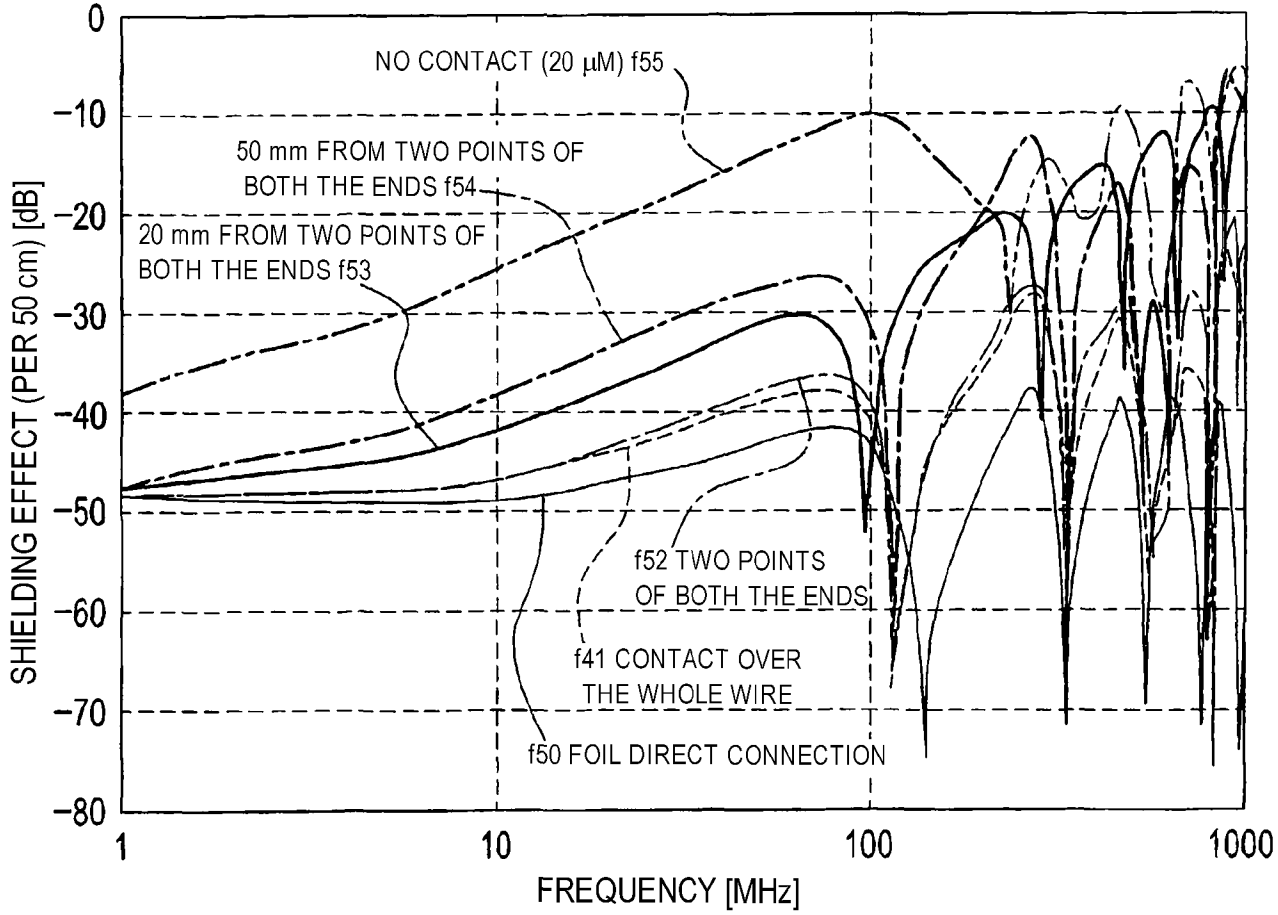
FIG. 8 is a graph obtained from measuring the shielding performance in the state that there are no peeled parts, by covering the periphery of the peeled parts with a cylindrical conductor, to see influence in the case where there are peeled parts and in the case where there are no peeled parts, in each of the simulations presented in FIG. 7.

FIG. 8 is a graph obtained from measuring the shielding performance in the state that there are no peeled parts, by covering the periphery of the peeled parts (parts B1 and B2 in FIG. 1) with a cylindrical conductor (cover), to see influence in the case where there are the peeled parts and the case where there are no peeled parts, in each of the simulations of FIG. 7.

In other words, each of the simulations in FIG. 8 was prepared by changing the wire length in each of the simulations presented in FIG. 5 to 50 cm.

A measurement result f51 in FIG. 8 was obtained in the case where the whole length of the wrapped metal foil member 8 is electrically connected to the drain wire 6, and corresponds to the measurement result f41 in FIG. 7. A measurement result f52 was obtained in the case where two points of both the ends of the wrapped metal foil member 8 are electrically connected to the drain wire 6, and corresponds to the measurement result f42 in FIG. 7. A measurement result f53 was obtained in the case where two points moved 20 mm from both the ends of the wrapped metal foil member 8 toward the interior side are electrically connected to the drain wire 6, and corresponds to the measurement result f43 in FIG. 7. A measurement result f54 was obtained in the case where two points moved 50 mm from both the ends of the wrapped metal foil member 8 toward the interior side are electrically connected to the drain wire 6, and corresponds to the measurement result f44 in FIG. 7. A measurement result f55 was obtained in the case where the wrapped metal foil member 8 is not electrically connected to the drain wire 6, and corresponds to the measurement result f45 in FIG. 7.

The measurement results f51, f52, f53, f54, and others in FIG. 8 confirm that the shielding effect is slightly improved in the case where there are no peeled parts. If more excellent shielding performance is required, the peeled parts at both the ends of the shielded electric wire wrapped with metal foil are preferably covered by a cylindrical conductor.

Additionally, FIG. 8 shows a measurement result f50 obtained in the case where the ends of the metal foil member 8 are not grounded via the drain wire 6 but are directly grounded.

The measurement result f50 exhibits a remarkably excellent shielding effect, compared to the measurement result f51 obtained in the case where both the ends of the drain wire 6, to which the whole length of the metal foil member 8 is electrically connected, are grounded.

Accordingly, if possible, both the ends of the metal foil member 8 provided in the shielded electric wire wrapped with metal foil are preferably directly grounded.

Figure 9:
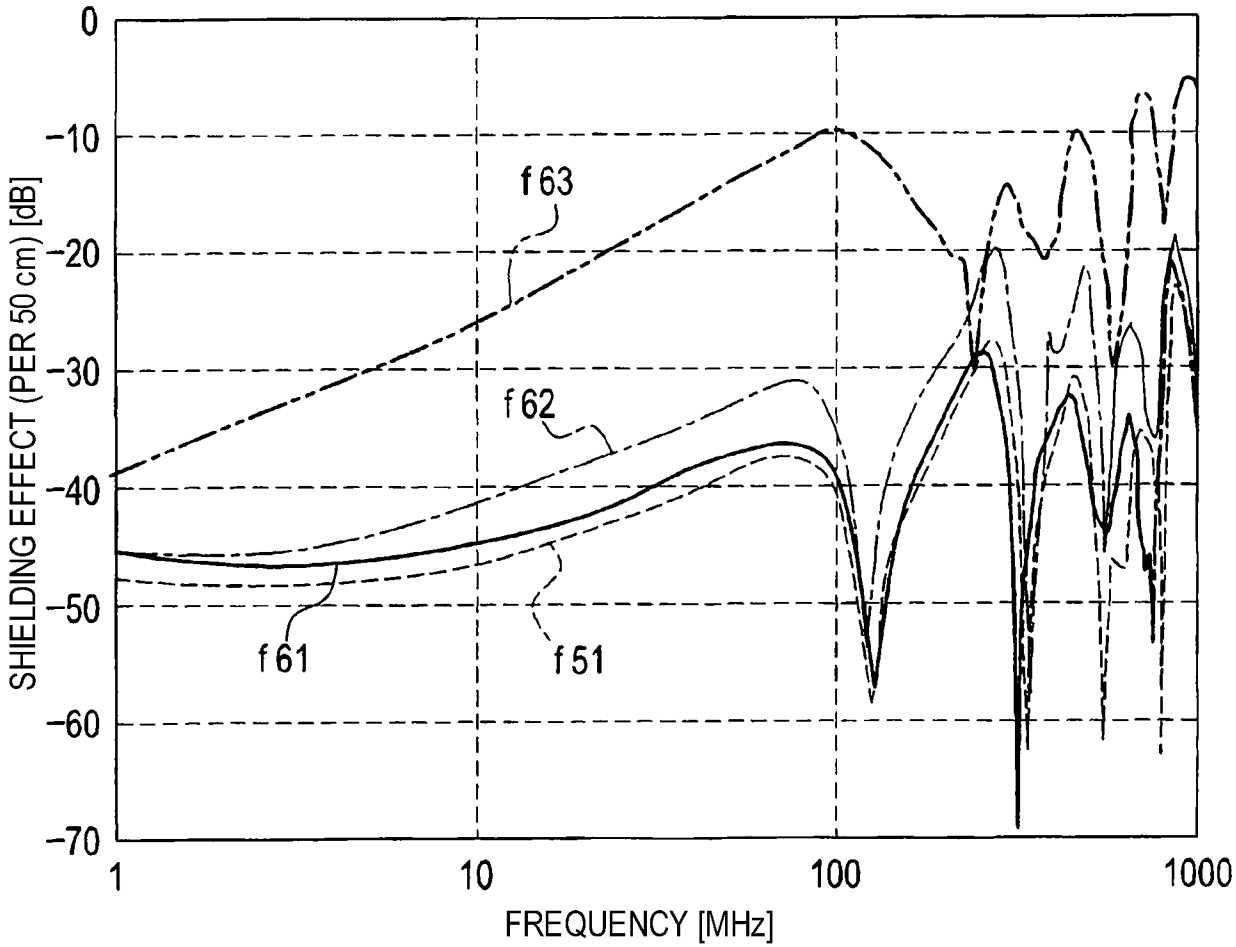
FIG. 9 is a graph obtained from measuring influence in the case where the range in which the drain wire is provided is limited to both the ends of the metal foil member, in the simulation of FIG. 8, in which there are no peeled parts.

FIG. 9 shows measurement results obtained from additionally measuring influence in the case where the range in which the drain wire is provided is limited to both the ends of the metal foil member, in the simulations of FIG. 8, in which there are no peeled parts.

A measurement result f51 in FIG. 9 was obtained in the case where the drain wire 6 is provided along the whole length of the coated conductive wire 3, such that the whole length of the metal foil member 8 is in contact with the drain wire 6, and copies the measurement result f51 of FIG. 8.

In measurement results f61 to f63 in FIG. 9, the range in which the drain wire 6 is provided is limited to 1 cm of both the ends of the metal foil member 8 wrapped around the coated conductive wire 3.

The measurement result f61 was obtained in the case where the whole length of the drain wire 6 provided at 1 cm of both the ends is electrically connected to the metal foil member 8. The shielding effect in the measurement result f61 is reduced by approximately 2 dB, compared to the measurement result f51, in which the whole length of the drain wire 6 provided along the whole range of the coated conductive wire 3 is electrically connected to the metal foil member 8. However, the shielding effect accomplished in the measurement result f61 is sufficient.

In that case, the shielding effect is reduced because in the shielded electric wire wrapped with metal foil, in which the drain wire is provided only at both the ends, a conductor cross-sectional area by the metal foil layer and the drain wire is reduced, compared to the normal case where the drain wire is extended over the whole length of the coated conductive wire.

The measurement result f62 was obtained in the case where the innermost ends of the drain wire 6 provided at 1 cm of both the ends are electrically connected to the metal foil member 8. The shielding effect in the measurement result f62 is further reduced by approximately 4 dB, compared to that in the measurement result f61. However, the shielding effect in the measurement result f62 sufficiently has a utilization value.

The measurement result f63 was obtained in the case where the drain wire 6 provided at 1 cm of both the ends is not in contact with the metal foil member 8. In this case, the shielding effect is significantly reduced and lacks utilization.

From the simulations in FIG. 9, it is confirmed that in the case where the range in which the drain wire 6 is provided is limited to the range of the defined length of both the ends of the coated conductive wire, when the drain wire 6 at both the ends is electrically connected to the metal foil member 8, a relatively satisfactory shielding effect is achieved.

Accordingly, in the shielded electric wire wrapped with metal foil of the present invention, the range in which the drain wire 6 is provided may be limited to the range of the defined length at both the ends of the coated conductive wire.

If the range in which the drain wire is provided is limited to the defined length at both the ends of the coated conductive wire, a use amount of the drain wire is reduced, so that costs reduction due to reduction of a used material, weight reduction, and arrangement (flexibility) improvement can be accomplished.

Hereinafter, the reason that the contact between the drain wire 6 and the metal foil member 8 affects the shielding property, and contacting the drain wire 6 and the metal foil member 8 at both the ends is effective will be described.

Figure 10A:
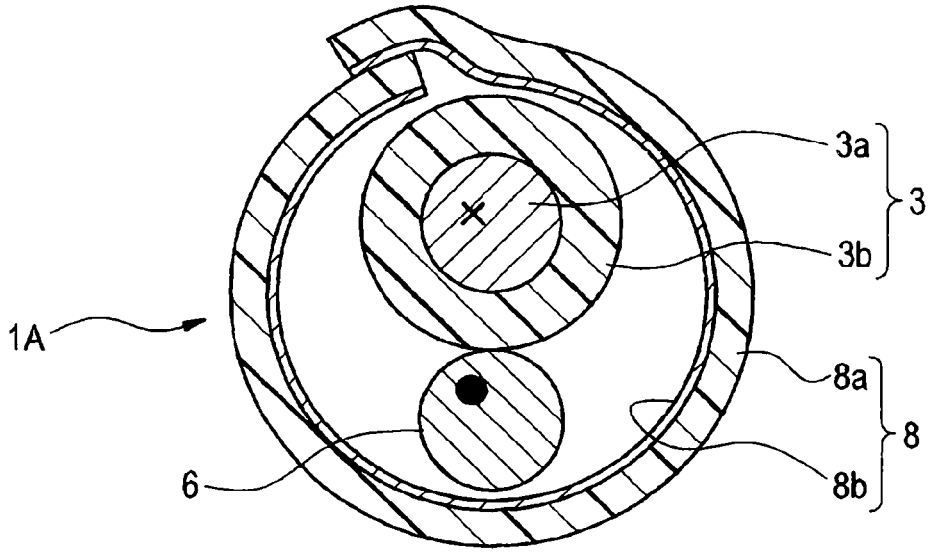
FIG. 10A is a cross-sectional view of a shielded electric wire in the state that the metal foil and the drain wire are not in contact with each other.

In the case where the drain wire 6 and the metal foil member 8 are not in contact with each other, a current in an opposite direction to the coated conductive wire 3 flows in the drain wire 6 as shown in FIG. 10A. However, since the current path is in the state of parallel two lines, leakage of a magnetic field into the periphery of the drain wire 6 cannot be prevented. Even if the drain wire 6 is grounded, the current is not shut off.

Figure 10B:
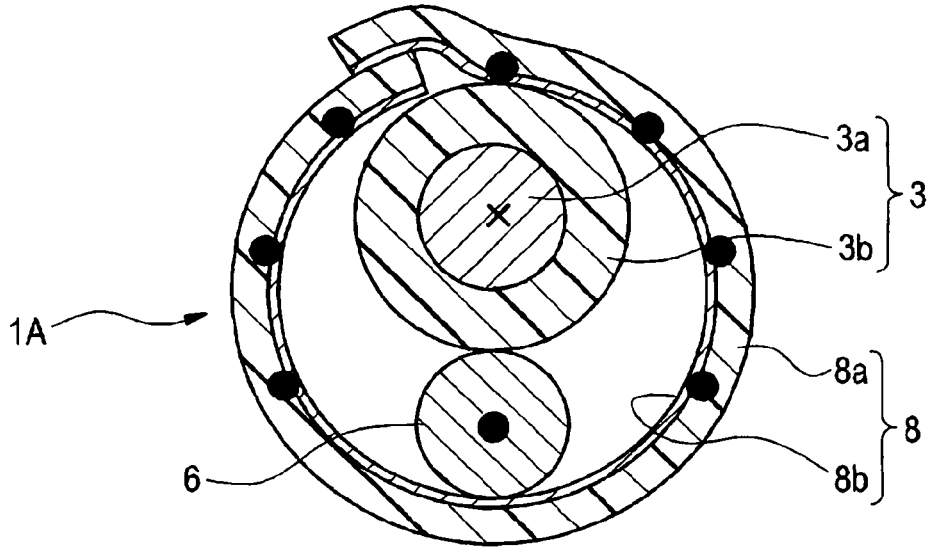
FIG. 10B is a cross-sectional view of a shielded electric wire in the state that the metal foil and the drain wire are in contact with each other.

However, in the case where the drain wire 6 and the metal foil member 8 are in contact with each other, a current in an opposite direction to the coated conductive wire 3 flows in the drain wire 6 and the metal foil member 8 as shown in FIG. 10B. As the current path is close to a coaxial line (a center of the current of the metal foil member 8 and the drain wire 6 is close to above the coated conductive wire 3), the effect in shutting off the magnetic field increases. If the drain wire 6 is grounded, an electric field also is shut off.

In case of the shielded electric wire 1A, the metal foil member 8 is connected to a shell of a shielded connector, a ground contact point on a substrate of equipment, housing, and others. In case of no contact, the effects in shutting off the electric field and the magnetic field are not achieved. In case of contact at one end, the effect only in shutting off the electric field can be achieved. In case of contact at both the ends, the effects in shutting off the electric field and the magnetic field can be achieved.

In case of contact at both the ends, the metal foil member 8 is the current path. In non-parallel lines, a current in an opposite direction to the current flowing in the coated conductive wire 3 flows, so that the magnetic field to be generated is shut off. Also, in case of parallel lines such as differential transmission, a current equal to that in the non-parallel lines flows in the metal foil member 8, so that shutting off the magnetic field is carried out.

Upon connection, the drain wire 6 extending from the electric wire 1A is connected to an external conductor, so that a current first flows in the drain wire 6. However, in the case where a current flows through the drain wire 6, the current flows in the form of covering the periphery of the coated conductive wire 3, so that the shutting off effect increases. Accordingly, if the current flows through the metal foil member 8 at a portion closer to the terminals of the shielded electric wire 1A, portions having the good shielding property increase, so that an inducement amount among lines is reduced.

As a result, actively contacting the drain wire 6 and the metal foil member 8 at both the terminals of the shielded electric wire 1A is preferable. To the end, it is preferable for the terminals to carry out fixing or others by a bonding band or tape, such that the metal foil layer (conductor surface) 8*b* of the interior side of the metal foil member 8 is surely in contact with the drain wire 6.

The present invention is not limited to the embodiment that has been described, and may be properly modified or altered. Materials, shapes, dimensions, numerical values, forms, the number, arrangement positions, and others of the elements in the embodiment that has been described are not limited, and may be properly adopted if the object of the present invention can be accomplished.

For example, configuration such as the number of core wires or drain wires, twisting of core wires or drain wires, and wrapping (lap winding, longitudinally providing, or others) with the metal foil member is not limited.

While the present invention has been described in detail or with reference to a specific embodiment, it is apparent to one skilled in the art that various modifications or corrections to the present invention may be added without departing from the spirit and the scope of the present invention.

The present application is based on the Japanese patent application (Japanese Patent Application No. 2009-157869) filed on Jul. 2, 2009, the disclosures of which are herein incorporated by way of reference.

INDUSTRIAL APPLICABILITY

The shielded electric wire wrapped with metal foil of the present invention can exhibit excellent shielding performance equal to that in the case where the metal foil member is in contact with the drain wire over the substantially whole length of the coated conductive wire. Accordingly, it is possible to stably produce a high-quality shielded electric wire wrapped with metal foil without causing variation in the shielding performance.

It is unnecessary to carry out the process for checking whether there is a non-contact portion between the metal foil member and the drain wire in a center part of the longitudinal direction of the electric wire, or the process for filling the non-contact portion with a conductive adhesive, after the process for wrapping the outer circumference of the coated conductive wire and the drain wire with the metal foil member. Accordingly, the manufacturing process is simplified, so that manufacturing costs can be reduced.

REFERENCE SIGNS LIST

1 shielded electric wire wrapped with metal foil
1A shielded electric wire wrapped with metal foil
3 coated conductive wire
3*a* core wire
3*b* insulation coating
4 coated conductive wire
6 drain wire
8 metal foil member
8*a* polyethylene film
8*b* aluminum foil layer (metal foil layer)
9 connection terminal
11 foil electrically connected part
13 adhesive tape
B1, B2 peeled parts

The invention claimed is:

1. A shielded electric wire wrapped with metal foil comprising:

a coated conductive wire;

a drain wire, provided along a length of the coated conductive wire and grounded at ends of the coated conductive wire; and a metal foil member, wrapped around the coated conductive wire and the drain wire, and forming a shielding layer covering a periphery of the coated conductive wire and the drain wire, wherein both ends or positions near both the ends of the metal foil member, which are positioned near both ends of the coated conductive wire, are foil electrically connected parts, which are electrically connected to the drain wire, and wherein each of the foil electrically connected parts comprises a first end connected to the metal foil member and a second end connected to the drain wire and extends from the first end towards the second end in a direction towards an end of the shielded electric wire nearest to where the respective foil electrically connected part is disposed.

2. The shielded electric wire wrapped with metal foil claimed in claim 1, wherein the drain wire is provided at a defined length of both the ends of the coated conductive wire.

3. The shielded electric wire wrapped with metal foil claimed in claim 1, wherein the foil electrically connected parts are not wrapped around the coated conductive wire.

4. The shielded electric wire wrapped with metal foil claimed in claim 1, wherein each of the foil electrically connected parts further comprise an adhesive tape.

* * * * *